United States Patent [19]

Walton et al.

[11] Patent Number: 4,785,644

[45] Date of Patent: Nov. 22, 1988

[54] CLOTHES WASHING MACHINE AND THE LIKE

[75] Inventors: Richard R. Walton, Ten West Hill Pl., Boston, Mass. 02114; Robert W. Young, Locust Valley, N.Y.; George E. Munchbach, Roslindale, Mass.

[73] Assignee: Richard R. Walton, Boston, Mass.

[21] Appl. No.: 932,038

[22] Filed: Nov. 18, 1986

[51] Int. Cl.[4] ..... S06F 15/00

[52] U.S. Cl. ..... 68/122; 68/129

[58] Field of Search ..... 68/23 R, 28, 38, 40, 68/51, 122, 123, 129, 132, 134, 184, 215, 216, 219; 366/242, 255, 256, 257, 258, 259, 260, 261, 285

[56] References Cited

U.S. PATENT DOCUMENTS

| | | |
|---|---|---|
| 155,812 | 10/1874 | Perry . |
| 368,233 | 8/1887 | Phelps et al. . |
| 1,089,809 | 3/1914 | Ambursen . |
| 1,184,838 | 5/1916 | Edwards . |
| 1,338,277 | 4/1920 | Beatty . |
| 2,231,046 | 2/1941 | Woodson . |
| 2,303,160 | 11/1942 | Dunham . |
| 2,770,118 | 11/1956 | Walton . |
| 2,770,119 | 11/1956 | Walton . |
| 2,770,120 | 11/1956 | Walton . |
| 2,770,123 | 11/1956 | Walton . |
| 3,071,955 | 1/1963 | Platt et al. . |
| 3,132,502 | 5/1964 | Walton . |
| 3,214,148 | 10/1965 | Thomas . |
| 3,367,153 | 2/1968 | Brubaker et al. . |
| 3,423,965 | 1/1969 | Walton . |
| 3,425,671 | 2/1969 | Van Der Lely . |
| 3,534,568 | 10/1970 | Tofflemire . |
| 3,592,026 | 7/1971 | Walton . |
| 4,193,275 | 3/1980 | Bochan . |

*Primary Examiner*—Philip R. Coe

[57] ABSTRACT

In a clothes washer of the type which has an array of tuckers and which is reciprocated vertically toward and away from the bottom of a container of washing liquid, a diaphragm is mounted to have an extended orientation during downward stroke for displacing liquid, and a relatively collapsed orientation during upward stroke, and a volume-outlining, clothes-restraining open uper structure provided over the diaphgram, this open structure extending upwardly from the diaphragm so that at least a part of it extends above the normal liquid level when the washer is in its lowest position. In action, as the diaphragm displaces liquid downwardly, the open structure, in following behind the diaphragm, restrains articles of clothes from moving inwardly over the diaphragm but allows liquid to move inwardly through the clothes and through the open structure to fill in behind the diaphragm. As it approaches the bottom of the container, the diaphragm applies an effective outward clothes-washing jet of liquid from between the diaphragm and the bottom surface of the container to prevent tangle of the downwardly-tucked clothes. During upward stroke the open structure and diaphragm are free to move upwardly with relatively low resistance.

31 Claims, 4 Drawing Sheets

FIG 1
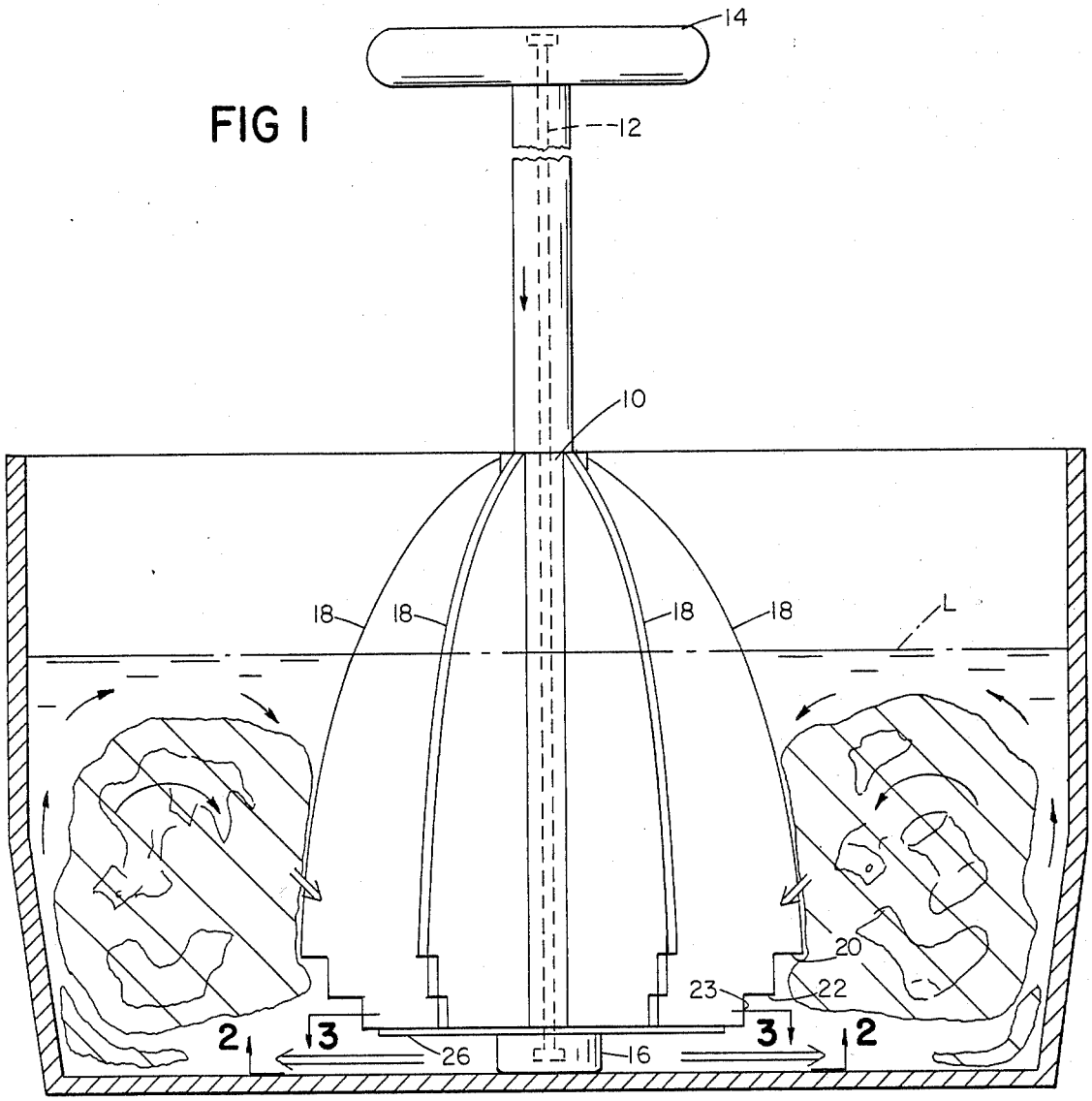
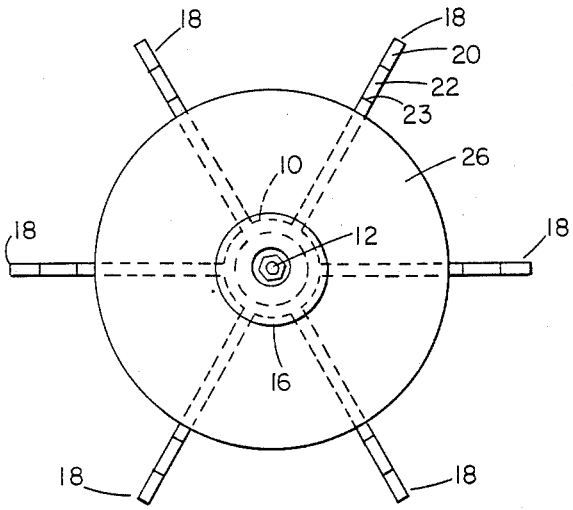
FIG 2
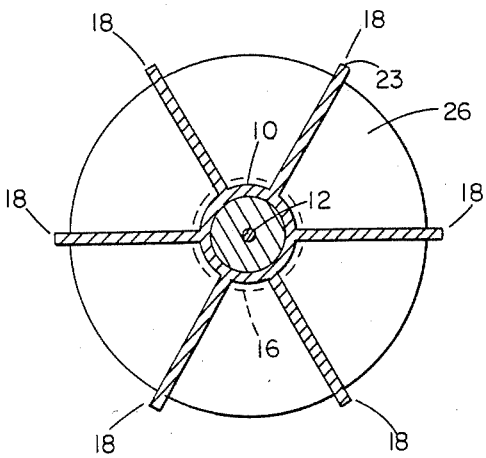
FIG 3

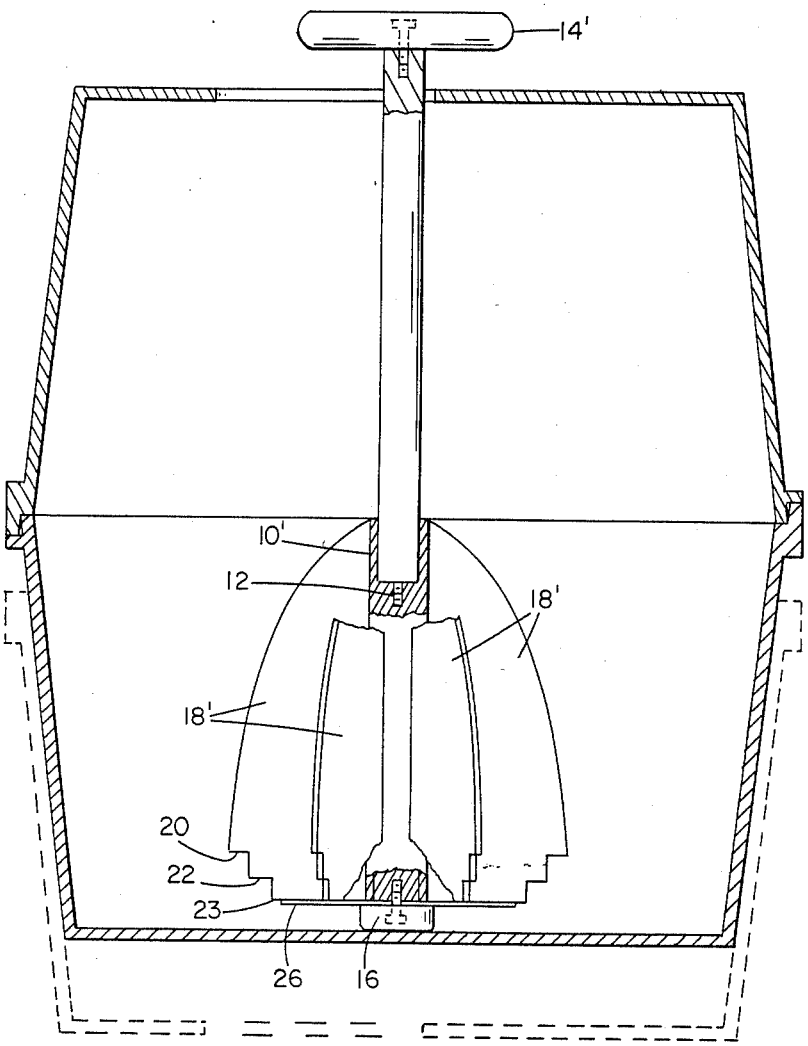
FIG 10
FIG 13
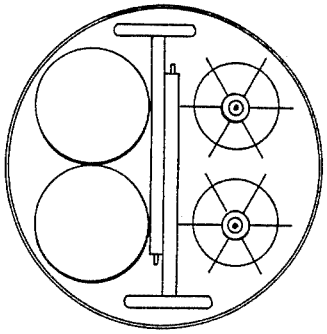
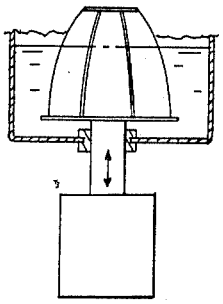
FIG 14
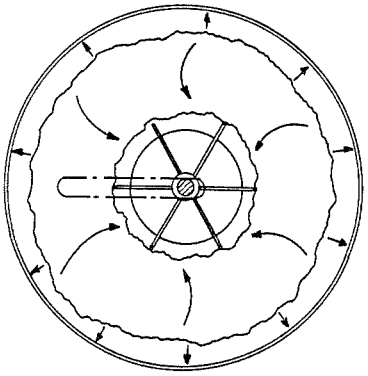
FIG 11
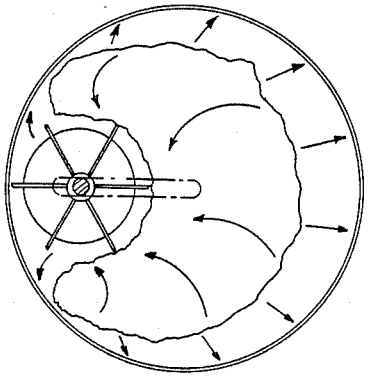
FIG 12

CLOTHES WASHING MACHINE AND THE LIKE

BACKGROUND OF THE INVENTION

This invention relates to clothes washing machines and the like. It has special application wherever a low cost or simple machine is needed, for instance in countries that have newly-developing economies and in remote places where electric power is unavailable.

SUMMARY OF THE INVENTION

The invention applies to a clothes washer of the type that is reciprocated vertically toward and away from the bottom of a container of washing liquid, in which an array of tuckers about the washer tuck downwardly the articles of clothes that lie about the washer, and in which a water displacement device creates a generally horizontal, outward flow of liquid against the clothes at the lower part of the washer. In such a washer the tuckers and water displacement device cause turning movement of the articles of clothes.

According to one aspect, the invention features a water displacement device in the form of a peripherally unconfined diaphragm means mounted to have an extended orientation during downward stroke for displacing liquid, and a relatively collapsed orientation during upward stroke, for enabling relatively free passage up through the water, and a volume-outlining, clothes-restraining open upper structure provided over the diaphragm means, this open structure extending upwardly from the diaphragm means so that at least a part of it extends above the normal liquid level when the washer is in its lowest position.

According to another aspect, the invention features a volume-outlining upper structure that lies over a diaphragm means, this structure comprising vertically extending fins, the outer edges of which outline the open volume, and permit low-resistance vertical motion of the upper structure through the liquid.

In the action of the washer, as the diaphragm means displaces liquid downwardly, the open structure, in following behind the diaphragm means, restrains articles of clothes from moving inwardly over the diaphragm means but allows liquid to move inwardly through the clothes and through the open structure to fill in behind the downwardly moving diaphragm means. As the washer approaches the bottom of the container, the diaphragm means applies an effective outward clothes-washing jet of liquid from between the diaphragm means and the bottom surface of the container to prevent tangle of the downwardly-tucked clothes. During upward stroke the open structure and diaphragm means are free to move upwardly with relatively low resistance.

In preferred embodiments of the invention, the tuckers of the washer are in the form of tucking points that are disposed radially outwardly of the diaphragm means, at a nonobstructing level that enables the diaphragm means to approach the bottom of the container very closely during the downward stroke to produce a strong jet; the outer surface of the volume-outlining structure is smooth in the vertical direction, capable of sliding past articles of clothes without substantial clothes-wearing effect or excessive foaming during the upward stroke; the volume-outlining open structure, at its periphery, has at least 80% open area to enable free flow of liquid through substantially all of the exposed surface of clothes that are restrained by the open structure during the downward stroke; the volume-outlining open structure has large flow openings, of arcuate extent over 30° in the direction about the washer; the volume-outlining structure comprises fin elements of continuous plate-form that are joined to a central support in the region of the central axis of the diaphragm means; the diaphragm means comprises a flexible member and lower edges of the volume-outlining structure are arranged to support this member in extended orientation during the downstroke; lower portions of the volume-outlining structure define tucking points, which preferably are a series of steps that descend inwardly relative to the washer and preferably the diaphragm-means comprises a planar flexible sheet-form member lying inwardly and below the lowest of these steps, preferably this sheet being secured centrally by an elastic protective cushion disposed below the diaphragm means.

According to certain preferred embodiments, the washer is hand driven, or driven by foot power by means of the nature of a bicycle chain system, or a simple low power motor is employed for driving the washer in its reciprocatory movement. In any of these cases, in some instances the washer is combined with a washing container and a lid fitted over the container, the lid having an operating aperture extending from the center region to a position nearer the periphery of the lid. This aperture is constructed to receive a vertically movable shaft, adapted to be reciprocated to stroke the washer up and down, and adapted to be shifted laterally through the slot from a central operating position to an offset operating position closer to a side wall of the container, the washer and the side wall, in that position, cooperating to increase the force of the clothes-washing jet in the direction away from the side wall, whereby a washing action of increased intensity can be selectively produced.

Washing machines made according to the invention have many advantages. The volume-outlining structure and the preferred unconfined diaphragm means enable a very efficient turning of the clothes, without tearing or rapid aging of the clothes and with a minimum of abrasion or wear-producing rubbing. The clothes rotate in a relatively loose toroidal mass, while individual articles are jetted free at the bottom of the container in an action that brings the solution into intimate contact with all areas of the clothing, thus allowing the washing or treatment function to be performed efficiently, as well as providing for an excellent mechanical rinse. As a result, a large number of clothes can be washed in a relatively small volume of the liquid, enabling conservation of washing aids or chemicals, hence economic use becomes possible of detergents, dyes, optic brighteners, bleaches and other clothes washing additives or treating materials even in countries in which cost is of extreme importance.

In the form of a hand-operated washing machine, the washer does not require the discrete dexterity of hand movement of an alert adult, but can be operated by inexperienced children or old people.

Although a tub wall can enhance the washing jet, the washer does not require a container or tube, e.g., it can be utilized in open water where the washer is reciprocated against the bottom of a shallow pool. In such instances the clothes will tend to retain their toroidal orientation.

Washing machines made according to the invention can be very low cost, lightweight, but yet durable and effective.

Beyond this and especially in a power driven version the agitation principles of this invention can be used in larger machines for dyeing or for washing long lengths of fabric.

A preferred embodiment of the invention will now be described with the drawings wherein:

DESCRIPTION OF THE DRAWINGS

FIG. 1 is a side view of the washer in its lowest position, disposed in a container of water containing articles of clothes;

FIG. 2 is taken on line 2—2 of FIG. 2, looking upwardly at the washer from the bottom, while FIG. 3 is a cross-sectional view taken on line 3—3 of FIG. 1, looking downwardly

FIG. 10 is a view similar to FIG. 2 of another preferred embodiment, while FIGS. 11 and 12 are diagrammatic views looking down upon the washer illustrating two different positions of action;

FIG. 13 is a plan view illustrating the packing of the components of the washer for shipment; and FIG. 14 is a diagrammatic view of a motor-operated version of the washer.

Referring to FIGS. 1–3, the washer of this embodiment comprises a cylindrical central tube 10, typically 6½ inches in diameter and 14 inches high, through which a connecting rod 12 runs, joined to handle 14 at the top and to a rubber cushion 16 at the bottom. The cushion 16 bears upon the lower horizontal edges of a nest of six vertically extending, typically 10 inch, plate-form fin elements 18 which are radially arranged with respect to central tube 10, typically at a diameter of 15½ inches, with angle a = 60° between adjacent elements. The inner edges of these fin elements are joined to the tube 10. The outer edges of these elements extend upwardly with gradually increasing curvature so that portions of the outer edges that lie below normal water level L when the washer is in its lowest position mainly have a vertical component, with only slight, but increasing slope, progressing upwardly, while portions above level L curve more steeply to the center.

Figure 5:
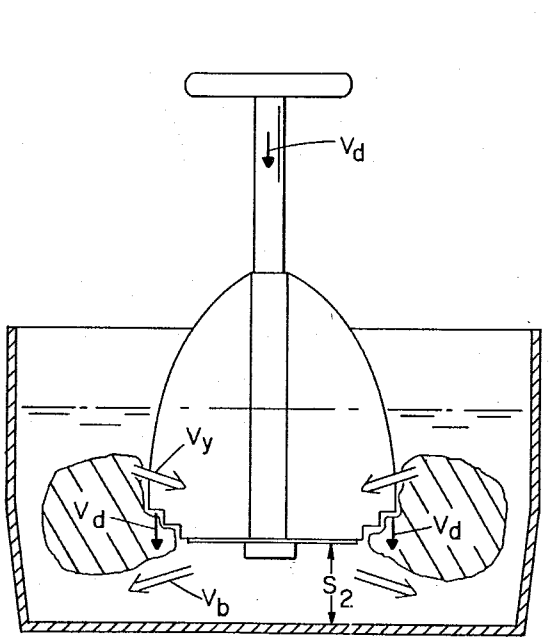
FIGS. 4, 5 and 6 are similar views illustrating three different stages of a downward stroke of the washer.

The lower, outer portions of these elements have vertical cutouts to decreased diameters towards the center, in step fashion, forming clothes-tucking points 20, 22.

A diaphragm 26 of flexible sheet material (polyester, 0.005 inch thick, e.g., of Dupont's Mylar*) of circular form has its free peripheral edge spaced inwardly from the last corner 23 of elements 18. It is held centrally against the lower edges 19 of these elements by the rubber cushion 16.

The diaphragm is peripherally unconfined, e.g., it is not surrounded by a cylinder, and its periphery is free to flex in pumping action. Thus, during downward motion, the diaphragm 26 is extended, held in generally horizontal planar form by reinforcement forces applied by the lower radial edges 19 of elements 18, see FIGS. 1 and 4–6, whereas, on upward motion, as shown in FIG. 7, the periphery of diaphragm 26 collapses downwardly in response to the water and presents a greatly reduced profile in the direction of travel.

Figure 6:
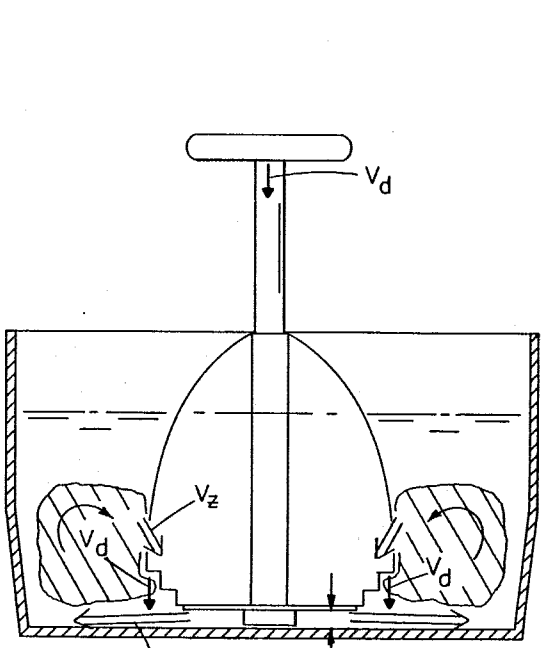
Figure 4:
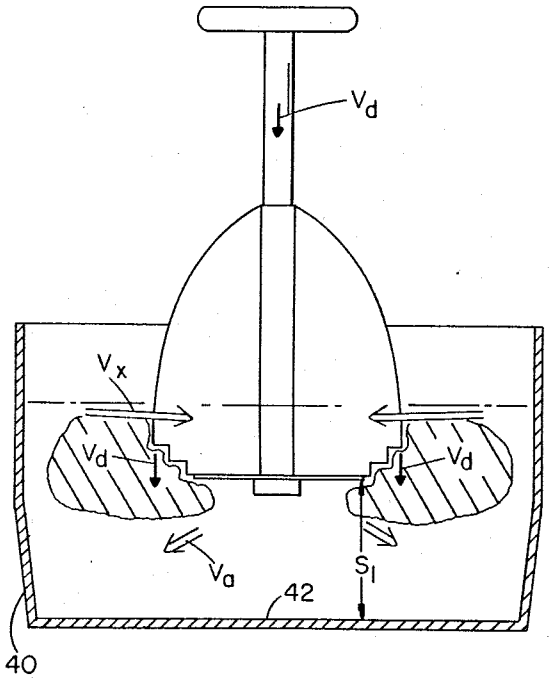
Figure 7:
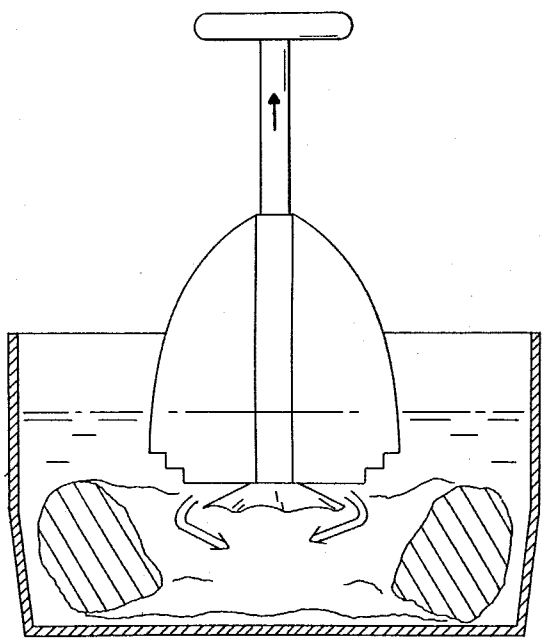
FIG. 7 is a view similar to FIGS. 4–6 depicting the washer in its upward stroke.

In FIGS. 4–6, for purposes of illustration, the washer is assumed to move downwardly at uniform velocity, $V_d$, thus displacing liquid at a constant rate. In FIG. 4, at the upper part of the stroke, as the washer moves downwardly, the circular diaphragm 26 displaces the water through the escape path $S_1$ between the bottom of the periphery of diaphragm 26 and bottom 42 of the container 40. As the washer approaches the bottom, the size of the escape path diminishes in cross section to $S_2$ in FIG. 5, and finally to $S_3$ in FIG. 6. Because of equal rate of water displacement at each of the three stages, FIGS. 4–6, while the size of the water escape path below the periphery of the diaphragm decreases, the average velocity of the escaping water therefore increases from $V_a$ to $V_b$ to $V_c$ and the average vector progressively turns outward, as shown in FIGS. 4–6.

Figure 8:
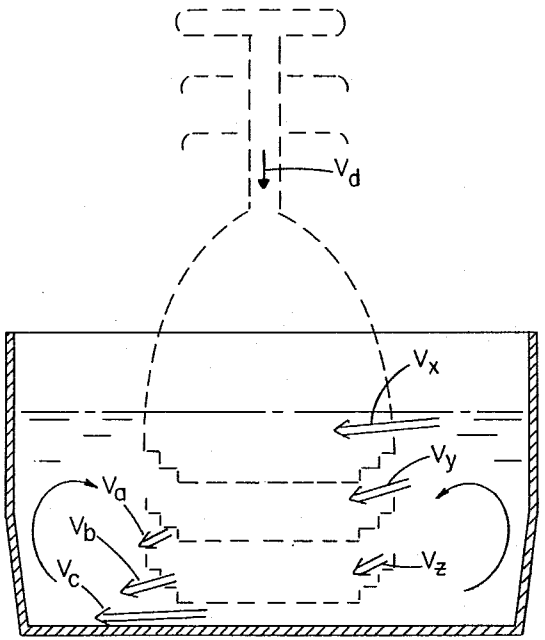
FIG. 8 is a diagrammatic view similar to FIGS. 4–6 illustrating the differences in the water flow vectors at the various stages of the downward stroke.

In opposite manner, the water filling in behind the downwardly moving diaphragm has a flow velocity through the clothes which is strongest at the upper part of the stroke, $V_x$, and weakest at the bottom $V_z$, and the vector turns progressively downward from its initial horizontal, inward orientation, as the stroke proceeds. FIG. 8 illustrates these differences in the water vectors.

In contrast to these water effects, the tucking points at all stages move against the clothes at a constant velocity corresponding to the downward velocity $V_d$ of the washer.

The combined effect is to set up an outwardly turning movement to the water at the bottom of the container, in a toroidal motion through the clothes. The clothes turn in response to motion of the water and the tucking points at a slower speed than the water movement.

By virtue of their shape, i.e., corners of a plate-form member, the tucking points are highly effective to assure the downward motion of portions of clothes engaged by the points, to ensure that the clothes reach the bottom of the container for exposure to the strongest jet action.

The washer is characterized by a thorough clothes washing action. During the downward stroke, as the outlined volume below surface L increases, the articles of clothes are drawn by water flow inwardly toward the open volume behind the diaphragm. However, the articles of clothes are restrained by the smooth edges of the nest of plate-form fin elements that, in skeletal form, outline the open volume. The water flows readily inwardly through the clothes and then into this open volume. Because of their narrow width, the fin elements have little masking effect, assuring that nearly all surfaces of the clothes at the periphery of the open structure are exposed to the through-flow of the inwardly moving liquid.

The tucking elements pull the articles of clothes down to expose new surfaces to the washing liquid, as the stroking action progresses. The tucking points have a relatively positive action in bringing the articles of clothing toward the bottom of the container. There the articles encounter the strong jet produced during final travel of the diaphragm against the bottom of the container.

If unaccompanied by this jet, the positive action of the tucking points over a number of strokes can cause bunching of the clothes into a tight tangle, preventing effective washing. The jet produced by the diaphragm, however, overcomes this bunching effect. The jet urges the clothes outwardly along the bottom of the container in a radiating flow of expanding diameter, loosening the articles at the bottom of the toroidal mass of clothes.

When the final portion of an article of clothes reaches the jet, the article is jetted free of the toroidal mass of clothes, as suggested in FIGS. 1 and 6. In this condition the article progresses outwardly and upwardly turning and reorienting to present different surfaces, before again entering the influence of the inwardly moving liquid at the top of the washer.

The upstroke of the washer has essentially a neutral effect. Because the diaphragm 19 collapses, as illustrated in FIG. 7, the liquid rushes around the edges of the small-profile diaphragm to fill in there behind. Because the lower edges of the plate-form fin elements 18 are at a greater diameter than the periphery of the diaphragm, clothes do not enter and jam between the diaphragm and elements 18, despite the unconfined nature of the diaphragm. Also, the upper edges of the sheet-form elements are smooth and readily permit sliding action past the clothes without abrasion or wear of the articles.

At the time of commencing the washing action of the manual machine shown in FIG. 1, typically about five pounds of clothes are uniformly distributed in the container in about 30 to 40 pounds of water and the washer is brought down on top of the clothes. In this condition both the outer and inner tucking elements 20, 22 engage the articles, see FIG. 4, to carry them downwardly to the bottom. The strong outward spreading jet at the bottom of the container then carries the clothes outwardly so that soon the toroidal flow is established and no clothes lie directly beneath the washer.

The washer operates with great effectiveness with stroking length and frequencies that are comfortable for hand operation by the individual operator. Stroke length of 3 to 4½ inches and stroke frequency of 1 to 3 seconds can result in effective washing. The faster the torus stroke speed the faster the clothes will rotate. Typically the torus will turn a full revolution every 5 to 10 strokes depending, e.g., upon the amount of clothes being washed as well as the specific stroke length and speed. Typically the torus surface moves at much slower speeds than the stroke speed, for instance at a ratio of ⅓ of the stroke speed. The relatively fast jet of water forced outwardly by the jet at the final stages of each stroke enables the clothes to flow free of torus at the bottom. While for any particular washer construction and load there is an optimal range of stroke length and speed, the washer has an extremely wide operable range and tolerates human imprecision without substantial decrease in washing efficiency. In motor driven versions the stroke length can be substantially shortened and the stroke speed substantially increased.

Figure 9:
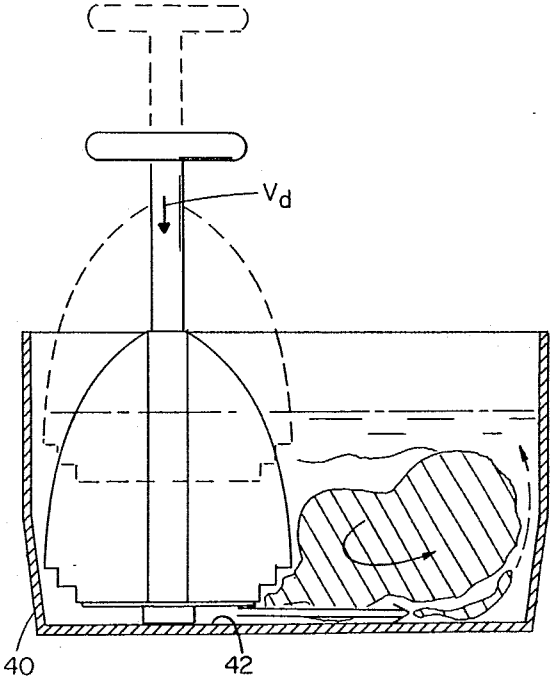
FIG. 9 is a view similar to FIGS. 4–6 illustrating the washing action when the washer is moved to the side of the container.

In the event that heavy articles of clothes are to be washed, the washing action can be increased in intensity by operating the washer close to a side wall of the container, as illustrated in FIG. 9. The side wall further limits the escape path for the final jet, giving the jet greater intensity in the direction away from the sidewall.

The embodiment of FIG. 10 comprises an integrally molded structure comprising central member 10' and volume-defining elements 18'. A cover 44 is provided and an elongated handle 14' is detachably secured to the central member. The cover has a slot 46 that enables operation of the washer in central position, FIG. 11, or in side position, FIG. 12, for increased jet action.

In FIG. 13 two washers are shown packed together within a washing container, with accompanying canisters of washing detergents.

In FIG. 14 a motor-driven washer is shown in which the central post is reciprocated by a shaft that extends upwardly through a seal at the bottom of the tub. In an alternative embodiment a top-mounted drive mechanism can be employed. Alternatively, in either case, a leg-powered drive mechanism, in the nature of bicycle sprockets and chain, can be substituted for the motor.

What is claimed is:

1. A clothes washer of the type that is reciprocated vertically toward and away from the bottom of a container of washing water, said washer having, for action during its downwardly stroke, an array of tucking points about the washer for tucking downwardly articles of clothes that lie about the washer, and a water displacement device for creating an outward flow of washing water against the clothes at the lower part of the washer, said tucking points and water displacement device cooperating to cause a turning movement of the articles of clothes, wherein said water displacement device comprises:

a peripherally unconfined washing water-propelling diaphragm means positioned near the bottom of said washer, mounted to have an extended orientation during downward stroke for displacing washing water and a relatively collapsed orientation during upward stroke for enabling relatively free passage of said washer up through the water, said diaphragm means mounted to permit its close approach to the bottom of said container during the final portion of its downward stroke, and a volume-outlining, clothes-restraining open upper structure extending upwardly from said diaphragm means so that at least a part of said open structure lies above the normal liquid level when said washer is in its lowest position, during said downward stroke, said open structure, in following behind said diaphragm means, being effective to restrain articles of clothes from moving inwardly over said diaphragm means while allowing washing water to move inwardly through the clothes and through said open structure to fill in behind the downwardly moving diaphragm means, said volume-outlining, clothes restraining open structure at its periphery, having at least 80% open area whereby liquid can freely flow through substantially all of the exposed surface of articles of clothes restrained by said open structure during said downward stroke, said unconfined diaphragm means, as it closely approaches the bottom of said container during downward stroke of said washer, being capable of applying an effective outward clothes-washing jet of liquid from between the diaphragm means and the bottom surface of said container to prevent tangle of the downwardly tucked clothes, and said open structure and diaphragm means being free to move in upward stroke with relatively low resistance, whereby an effective washing action is achieved with a simple washer construction.

2. A clothes washer of the type that is reciprocated vertically toward and away from the bottom of a container of washing water, said washer having, for action during its downwardly stroke, an array of tucking points about the washer for tucking downwardly articles of clothes that lie about the washer, and a water displacement device for creating an outward flow of washing water against the clothes at the lower part of the washer, said tucking points and water displacement device cooperating to cause a turning movement of the articles of clothes, wherein said water displacement device comprises:

a peripherally unconfined washing water-propelling diaphragm means positioned near the bottom of said washer, mounted to have an extended orientation during downward stroke for displacing washing water and a relatively collapsed orientation during upward stroke for enabling relatively free passage of said washer up through the water, said diaphragm means mounted to permit its close approach to the bottom of said container during the final portion of its downward stroke, and a volume-outlining, clothes-restraining open upper structure extending upwardly from said diaphragm means so that at least a part of said open structure lies above the normal liquid level when said washer is in its lowest position, during said downward stroke, said open structure, in following behind said diaphragm means, being effective to restrain articles of clothes from moving inwardly over said diaphragm means while allowing washing water to move inwardly through the clothes and through said open structure to fill in behind the downwardly moving diaphragm means, said volume-outlining, clothes restraining open structure having large flow openings that have an arcuate extent of over 30° in the direction about the washer, said unconfined diaphragm means, as it closely approaches the bottom of said container during downward stroke of said washer, being capable of applying an effective outward clothes-washing jet of liquid from between the diaphragm means and the bottom surface of said container to prevent tangle of the downwardly tucked clothes, and said open structure and diaphragm means being free to move in upward stroke with relatively low resistance, whereby an effective washing action is achieved with a simple washer construction.

3. The clothes washer of claim 1 or 2 wherein at least the lowest set of said tucking points are disposed radially outwardly of the periphery of said diaphragm means, at a level that enables said diaphragm means to closely approach the bottom of said container during its downward stroke and to cause water jetted by said diaphragm means to impinge directly on clothes that have been tucked downwardly by said lowest set of tucking points.

4. The clothes washer of claim 1 or 2 wherein said volume-outlining, clothes-restraining, open structure comprises a nest of vertically arranged, peripherally spaced apart elements, the outer surfaces of which combine to outline said defined volume.

5. The clothes washer of claim 4 wherein said elements comprise fins joined to a central support in the region of the central axis of said diaphragm means.

6. The clothes washer of claim 4 wherein said diaphragm means comprises a sheet-form member, and lower edges of said elements are arranged to support said sheet-form member in extended orientation during said downstroke.

7. The clothes washer of claim 4 wherein lower edges of said elements define said tucking points.

8. The clothes washer of claim 7 wherein each element defines a plurality of tucking points in the form of a series of steps that descend inwardly relative to said washer.

9. The clothes washer of claim 7 wherein said diaphragm means comprises a planar sheet-form member lying inwardly and below the lowest steps on said elements.

10. A clothes washer of the type that is reciprocated vertically toward and away from the bottom of a container of washing water, said washer having, for action during its downwardly stroke, an array of tucking points about the washer for tucking downwardly articles of clothes that lie about the washer, and a water displacement device for creating an outward flow of washing water against the clothes at the lower part of the washer, said tucking points and water displacement device cooperating to cause a turning movement of the articles of clothes, wherein said water displacement device comprises:

a peripherally unconfined washing water-propelling diaphragm means positioned near the bottom of said washer, mounted to have an extended orientation during downward stroke for displacing washing water and a relatively collapsed orientation during upward stroke for enabling relatively free passage of said washer up through the water, said diaphragm means mounted to permit its close approach to the bottom of said container during the final portion of its downward stroke, and a volume-outlining, clothes-restraining open upper structure extending upwardly from said diaphragm means so that at least a part of said open structure lies above the normal liquid level when said washer is in its lowest position, during said downward stroke, said open structure, in following behind said diaphragm means, being effective to restrain articles of clothes from moving inwardly over said diaphragm means while allowing washing water to move inwardly through the clothes and through said open structure to fill in behind the downwardly moving diaphragm means, said volume-outlining, clothes restraining open structure comprising a nest of vertically arranged, peripherally spaced apart elements, the outer surfaces of which combine to outline said defined volume, said unconfined diaphragm means, as it closely approaches the bottom of said container during downward stroke of said washer, being capable of applying an effective outward clothes-washing jet of liquid from between the diaphragm means and the bottom surface of said container to prevent tangle of the downwardly tucked clothes, and said open structure and diaphragm means being free to move in upward stroke with relatively low resistance, whereby an effective washing action is achieved with a simple washer construction.

11. The clothes washer of claim 1, 2 or 10 wherein the outer surface of said volume-outlining structure is smooth in the upward direction, and inclined at no more than an acute angle to the vertical, capable of sliding freely past articles of clothes without substantial drag, rubbing, or lifting effect during said upward stroke.

12. The clothes washer of claim 10 wherein at least the lowest set of said tucking points are disposed radially outwardly of the periphery of said diaphragm means, at a level that enables said diaphragm means to closely approach the bottom of said container during its downward stroke and to cause water jetted by said diaphragm means to impinge directly on clothes that have been tucked downwardly by said lowest set of tucking points.

13. The clothes washer of claim 10 or 12 wherein said elements comprise fins joined to a central support in the region of the central axis of said diaphragm means.

14. The clothes washer of claim 10 or 12 wherein said diaphragm means comprises a sheet-form member, and lower edges of said elements are arranged to support said sheet-form member in extended orientation during said downstroke.

15. The clothes washer of claim 10 or 12 wherein lower edges of said elements define said tucking points.

16. The clothes washer of claim 15 wherein each element defines a plurality of tucking points in the form of a series of steps that descend inwardly relative to said washer.

17. The clothes washer of claim 16 wherein said diaphragm means comprises a planar sheet-form member lying inwardly and below the lowest steps on said elements.

18. The clothes washer of the type that is reciprocated vertically toward and away from the bottom of a container of washing water, said washer having, for action during its downward stroke, an array of tucking points about the washer for tucking downwardly articles of clothes that lie about the washer, and a water displacement device for creating an outward flow of washing water against the clothes at the lower part of the washer, said tucking points and water displacement device cooperating to cause a turning movement of the articles of clothes, wherein said water displacement device comprises:

a diaphragm means mounted to have an extended orientation during downward stroke for displacing washing water and a relatively collapsed orientation during upward stroke for enabling relatively free passage of said washer up through the water, said diaphragm means mounted to permit its close approach portion to the bottom of said container during the final of its downward stroke, and a volume-outlining, clothes-restraining open upper structure extending upwardly from said diaphragm means so that at least a part of it lies above the normal liquid level when said washer is in its lowest position, said volume-outlining structure comprising vertically extending, peripherally spaced apart fin elements, the outer surfaces of which combine to outline said defined volume, and lower, outer portions of which provide said tucking points, at least the lowest set of said tucking points being disposed radially outwardly of the periphery of said diaphragm means, at a level that enables said diaphragm means to closely approach the bottom of said container during its downward stroke and to cause water jetted by said diaphragm means to impinge directly on clothes that have been tucked downwardly by said lowest set of tucking points, said open structure, as said diaphragm means displaces liquid downwardly during said downward stroke, being effective in following behind said diaphragm means to restrain articles of clothes from moving inwardly over said diaphragm means while allowing liquid to move inwardly through the clothes and through said open structure to fill in behind the downwardly moving diaphragm means, and said open structure and diaphragm means being free to move in upward stroke with relatively low resistance, whereby an effective washing action is achieved with a simple washer construction.

19. The clothes washer of claim 18 wherein lower outer portions of said fin elements define a plurality of tucking points in the form of a series of steps that descend inwardly relative to said washer.

20. The clothes washer of claim 18 or 19 wherein said diaphragm means comprises a sheet-form member and lower edges said fin elements are arranged to support said sheet-form member in extended orientation during said downstroke.

21. The clothes washer of claim 18 or 19 wherein the outer edge surfaces of said fin elements are smooth in the upward direction, capable of sliding freely past articles of clothes without substantial drag or rubbing effect during said upward stroke.

22. The clothes washer of claim 18 or 19 wherein adjacent fin elements are spaced apart over 30° in the direction about the washer to provide at the periphery a large open area whereby liquid can freely flow through substantially all of the exposed surface of articles of clothes restrained by said open structure during said downward stroke.

23. A clothes washer mounted for reciprocating vertically in a container of washing liquid, said clothes washer comprising a volume-outlining, clothes-restraining open upper structure extending above the level of washing liquid in all positions of reciprocation of said clothes washer in the container, tucking means defined about the clothes washer, and a peripherally unconfined water-displacing diaphragm means disposed below said upper volume-outlining structure, said diaphragm means mounted upon said clothes washer in a manner to permit close approach of said diaphragm means to the bottom of the container, during a final portion of downward reciprocation of said clothes washer in the container, said diaphragm means comprising a flexible sheet-form member mounted centrally, backing means disposed above said flexible sheet member adapted to support said sheet-form member during said downstroke, and peripheral portions of said sheet-form member being free to collapse downwardly during upstroke to enable relatively free passage of said washer up through the water.

24. The clothes washer of claim 23, wherein an elastic cushion member is disposed centrally beneath said flexible membrane, arranged to prevent said membrane from striking the bottom of said container.

25. The clothes washer of claim 24 wherein said cushion member is centrally secured to said upper structure, said sheet-form diaphragm member being held between said cushion and said structure.

26. A clothes washer of the type that is reciprocated vertically toward and away from the bottom of a container of washing liquid, said washer having, for action during its downward stroke, an array of tucking points about the washer for tucking downwardly articles of clothes that lie about the washer, and a water displacement device for creating an outward flow of liquid against the clothes at the lower part of the washer, said tucking points and water displacement device cooperating to cause a turning movement of the articles of clothes, wherein said water displacement device comprises:

a peripherally unconfined diaphragm means mounted to have an extended orientation during downward stroke for displacing washing water and a relatively collapsed orientation during upward stroke for enabling relatively free passage of said washer up through the water, and a volume-outlining, clothes-restraining upper structure extending upwardly from said diaphragm means so that at least a part of it lies above the normal liquid level when said washer is in its lowest position, during said downward stroke, said volume-defining structure, in following behind said diaphragm means, being effective to restrain articles of clothes from moving inwardly over said diaphragm means, said unconfined diaphragm means, as it closely approaches the bottom of said container during downward stroke of said washer, being capable of applying an effective outward clothes-washing jet of liquid from between the diaphragm means and the bottom surface of said container to prevent tangle of the downwardly tucked clothes, said tucking points being disposed radially outwardly of the periphery of said diaphragm means, at a nonobstructing level that enables said diaphragm means to closely approach the bottom of said container during its downward stroke and to cause water jetted by said diaphragm means to impinge directly on clothes that have been tucked downwardly by said lowest set of tucking points, and said open structure and diaphragm means being free to move in upward stroke with relatively low resistance, whereby an effective washing action is achieved with a simple washer construction.

27. The clothes washer of claim 26 wherein the outer surface of said volume-outlining structure is smooth in the upward direction, and inclined at no more than an acute angle to the verticle, capable of sliding freely past articles of clothes wthout substantial drag, rubbing or lifting effect during said upward stroke.

28. A clothes washer of the type that is reciprocated vertically toward and away from the bottom of a container of washing liquid, said washer having, for action during its downward stroke, an array of tucking points about the washer for tucking downwardly articles of clothes that lie about the washer, and a water displacement device for creating an outward flow of washing water against the clothes at the lower part of the washer, said tucking points and water displacement device cooperating to cause a turning movement of the articles of clothes, wherein said water displacement device comprises:

a diaphragm means mounted to have an extended orientation during downward stroke for displacing liquid and a relatively collapsed orientation during upward stroke for enabling relatively free passage of said washer up through the water, and a volume-outlining, clothes-restraining upper structure extending upwardly from said diaphragm means so that at least a part of it lies above the normal liquid level when said washer is in its lowest position, during said downward stroke, said volume-defining structure, in following behind said diaphragm means, being effective to restrain articles of clothes moving inwardly over said diaphragm means, said diaphragm means, as it closely approaches the bottom of said container during downward stroke of said washer, being capable of applying an effective outward clothes-washing jet of liquid from between the diaphragm means and the bottom surface of said container to prevent tangle of the downwardly tucked clothes, at least the lowest set of said tucking points being disposed radially outwardly of the periphery of said diaphragm means, at a nonobstructing level that enables said diaphragm means to closely approach the bottom of said container during its downward stroke and to cause water jetted by said diaphragm means to impinge directly on clothes that have been tucked downwardly by said lowest set of tucking points, and said open structure and diaphragm means being free to move in upward stroke with relatively low resistance, the outer surface of said volume-outlining structure being smooth in the upward direction, and inclined at no more than an acute angle to the vertical, capable of sliding freely past articles of clothes without substantial drag, rubbing, or lifting effect during said upward stroke, whereby an effective washing action is achieved with a simple washer construction.

29. The clothes washer of claim 1, 2, 10, 18, 23, 26 or 28 including an operating shaft in the form of a handle adapted to be manually reciprocated for operation of said washer.

30. The clothes washer of claim 1, 2, 10, 18, 23, 26 or 28 including motor means for driving said washer in its reciprocating movement.

31. A clothes washer according to claim 1, 2, 10, 18, 23, 26 or 28 in combination with a washing container and a lid fitted over the container, the lid having an operating aperture extending from the center region to a position nearer the periphery of the lid, said aperture constructed to receive a vertical, movable shaft, said shaft connected to said washer and adapted to be reciprocated to stroke said washer up and down, and said shaft adapted to be shifted laterally through said slot whereby said washer can be shifted from a central operating position to an offset operating position, said washer, in said offset operating position, being relatively closer to a side wall of said container than in said central position, said washer and side wall cooperating to increase the force of clothes-washing jet produced by said diaphragm means at the bottom of said container in the direction away from said side wall, whereby a washing action of increased intensity can be selectively produced.

* * * * *

UNITED STATES PATENT AND TRADEMARK OFFICE

CERTIFICATE OF CORRECTION

PATENT NO. : 4,785,644

DATED : November 22, 1988

INVENTOR(S) : Richard R. Walton et al.

It is certified that error appears in the above-identified patent and that said Letters Patent are hereby corrected as shown below:

In the Abstract

Line 7, "uper" is changed to --upper--.

In the Specification

Column 3, line 18, insert --;-- after "downwardly".

Column 3, line 46, "a=60°" is changed to --*a*=60°-- ("a" is italicized).

Column 3, line 56, insert --,-- between "cutouts" and "to".

Signed and Sealed this

Twenty-eighth Day of March, 1989

*Attest:*

*Attesting Officer*

DONALD J. QUIGG

*Commissioner of Patents and Trademarks*